US005878790A

United States Patent [19]

Janssen

[11] Patent Number: 5,878,790

[45] Date of Patent: Mar. 9, 1999

[54] RECOVERY SYSTEM FOR RECOVERING HYDROCARBON VAPOR AND OFFERING IMPROVED STABILITY

[75] Inventor: Sylvain Janssen, Neuilly sur Seine, France

[73] Assignee: Schlumberger Industries, Montrouge, France

[21] Appl. No.: 793,650

[22] PCT Filed: Jul. 2, 1996

[86] PCT No.: PCT/FR96/01031

§ 371 Date: Mar. 4, 1997

§ 102(e) Date: Mar. 4, 1997

[87] PCT Pub. No.: WO97/02208

PCT Pub. Date: Jan. 23, 1997

[30] Foreign Application Priority Data

Jul. 6, 1995 [FR] France ..... 95 08194

[51] Int. Cl.[6] ..... B67D 5/378

[52] U.S. Cl. ..... 141/59; 141/45; 141/290; 417/205; 417/253; 417/295

[58] Field of Search ..... 141/7, 44, 45, 141/59, 290; 417/199.1, 205, 253, 295

[56] References Cited

U.S. PATENT DOCUMENTS 2,936,107 5/1960 Blackburn ..... 417/205
4,256,151 3/1981 Gumm ..... 141/59
4,260,000 4/1981 McGahey et al. ..... 141/59
5,291,922 3/1994 Martin et al. ..... 141/59
5,363,649 11/1994 McBurnett et al. ..... 417/295
5,484,000 1/1996 Hasselmann ..... 141/7
5,542,458 8/1996 Payne et al. ..... 141/7

*Primary Examiner*—J. Casimer Jacyna
*Attorney, Agent, or Firm*—Frishauf, Holtz, Goodman, Langer & Chick, P.C.

[57] ABSTRACT

A recovery system for recovering hydrocarbon vapor given off by motor vehicle tanks while they are being filled with liquid fuel via at least one dispensing pipe. According to the invention, said recovery system comprises a recovery pipe associated with said dispensing pipe, a power pump placed on said recovery pipe, and a metering pump driven by a motor at an angular velocity that is substantially proportional to the volume flow rate of liquid fuel delivered by the dispensing pipe, said metering pump being mounted in series with said power pump via a differential pressure expander-regulator suitable for maintaining a pressure difference that is small between the outlet and the inlet of the metering pump so as to obtain a vapor volume flow rate that is substantially proportional to the angular velocity imparted by said motor. Application to dispensing liquid fuel.

6 Claims, 4 Drawing Sheets

RECOVERY SYSTEM FOR RECOVERING HYDROCARBON VAPOR AND OFFERING IMPROVED STABILITY

The present invention relates to a recovery system for recovering hydrocarbon vapor given off by motor vehicle tanks while they are being filled with liquid fuel via at least one dispensing pipe.

BACKGROUND OF THE INVENTION

In gas stations delivering liquid fuel, each of the dispensing pipes is terminated by a hose pipe equipped at one end with a gun that the user inserts into the feed pipe of the tank of the vehicle.

Naturally, as the tank fills, an equivalent volume of hydrocarbon vapor that it contains escapes to the outside via said feed pipe. In principle, vapor recovery thus consists in sucking up at the outlet of the feed pipe a volume of vapor that must at all times be equal to the delivered volume of liquid fuel. For this purpose, the dispensing gun is equipped with a sleeve which penetrates into the outlet orifice of the tank of the vehicle, and into which the upstream end of a recovery pipe opens out, on which recovery pipe a suction pump is placed which returns the recovered hydrocarbon vapor to the storage tank for storing the liquid fuel. For the recovery system to operate satisfactorily, it must be possible to vary the speed of rotation of the pump so that the instantaneous volume of sucked-up vapor equals the instantaneous volume of dispensed liquid.

With known recovery systems, of the type including a vapor suction pump with the flow rate being regulated by varying its speed of rotation, it is difficult for the volume flow rate of the liquid being supplied and the volume flow rate of the vapor being recovered to be kept equal in all circumstances because:

- inevitable internal leaks exist in rotary vapor pumps, the size of the leaks increasing with wear and with the upstream-downstream pressure difference that such pumps must generate to cause the vapor to flow and to be transferred to the storage tank;
- it is impossible to be aware at all times of the states of the vapor recovery pipes, especially those integrated in the fuel-dispensing hose pipes, it being possible for their headloss coefficients to vary considerably over time; and
- the pressure in the storage tank varies.

One known way of avoiding those drawbacks consists in inserting into the recovery pipe a gas flow meter optionally associated with a pressure sensor so as to servo-control the speed of rotation of the vapor pump or the opening of a valve so as to obtain the desired vapor flow rate.

However, this method makes it necessary to implement a rapid-response servo-control loop receiving flow-rate and pressure information supplied by the measurement sensors and acting on the actuator after comparing the information with a reference value that can itself vary very rapidly over time with the flow rate of liquid fuel as controlled by the user.

OBJECTS AND SUMMARY OF THE INVENTION

The technical problem to be solved by the present invention is to provide a recovery system for recovering hydrocarbon vapor given off by motor vehicle tanks while they are being filled with liquid fuel via at least one dispensing pipe, which system makes it possible to obtain good proportionality between the flow rate of vapor to be recovered and the speed of rotation of the vapor pump, such as a pump having vanes, gears, or rotary pistons, without having to use a complex and costly servo-control loop such as the loop described above with reference to the state of the art.

According to the present invention, the solution to the technical problem posed consists in that said system comprises a recovery pipe associated with said dispensing pipe, a power pump placed on said recovery pipe, and a metering pump driven by a motor at an angular velocity that is substantially proportional to the volume flow rate of liquid fuel delivered by the dispensing pipe, said metering pump being mounted in series with said power pump via a differential pressure expander-regulator suitable for maintaining a pressure difference that is small between the outlet and the inlet of the metering pump so as to obtain a vapor volume flow rate that is substantially proportional to the angular velocity imparted by said motor.

In this way, the accuracy of the metering pump is made to comply with the regulations by the presence across its terminals of the expander-regulator which constrains said pump to operate under a differential pressure that is very small and if possible zero, the internal leaks becoming negligible. Since the volume flow rate of vapor is proportional to the speed of rotation of the motor, which speed is itself proportional to the volume flow rate of liquid fuel, it can then be understood that it is possible to obtain the desired equality between the flow rate of vapor and the flow rate of liquid, regardless of the delivery flow rate, the nature of the gas, the state of wear of the pump, or the flow resistance of the recovery pipe.

Under these operating conditions, the metering pump can supply limited power only for causing the vapor to flow. For this purpose, it must be assisted by the power pump, that is capable of providing at least the maximum demanded flow rate under any circumstances.

The metering pump is thus capable of metering the volumes of vapor passing through the entire recovery system, and of playing a part comparable to that of a flow-rate regulating valve but with metering of much higher quality as a result of the absence of expansion.

A fraction of the power supplied by the motor for driving the metering pump serves to overcome the mechanical friction of the pump, the remainder of said power serving to cause the recovered vapor to flow and to be transferred under a very low differential pressure, and therefore at very low power.

Two embodiments of the recovery system of the invention may be considered.

In a first embodiment, said metering pump is mounted in series with and downstream from the power pump. Optionally a pressure regulator may be disposed downstream from the metering pump and from said differential pressure expander-regulator.

In a second embodiment, said metering pump is mounted in series with and upstream from the power pump, an expander being disposed upstream from the metering pump and from said differential pressure expander-regulator.

The latter embodiment offers the advantage that, with there being a plurality of said dispensing pipes, the power pump is common and is placed on a common portion that is common to the respective recovery pipes, downstream from said differential pressure expander-regulators.

Finally, a preferred configuration of the recovery system of the invention leading to an implementation that is simple and cheap consists in that said power pump and said metering pump are driven by a common motor at an angular velocity that is substantially proportional to said volume flow rate of delivered liquid fuel, the power pump having a cycle volume that is greater than the cycle volume of the metering pump.

BRIEF DESCRIPTION OF THE DRAWINGS

The invention and how it may be implemented can be well understood from the following description given by way of non-limiting example and with reference to the accompanying drawings, in which.

MORE DETAILED DESCRIPTION

Figure 1:
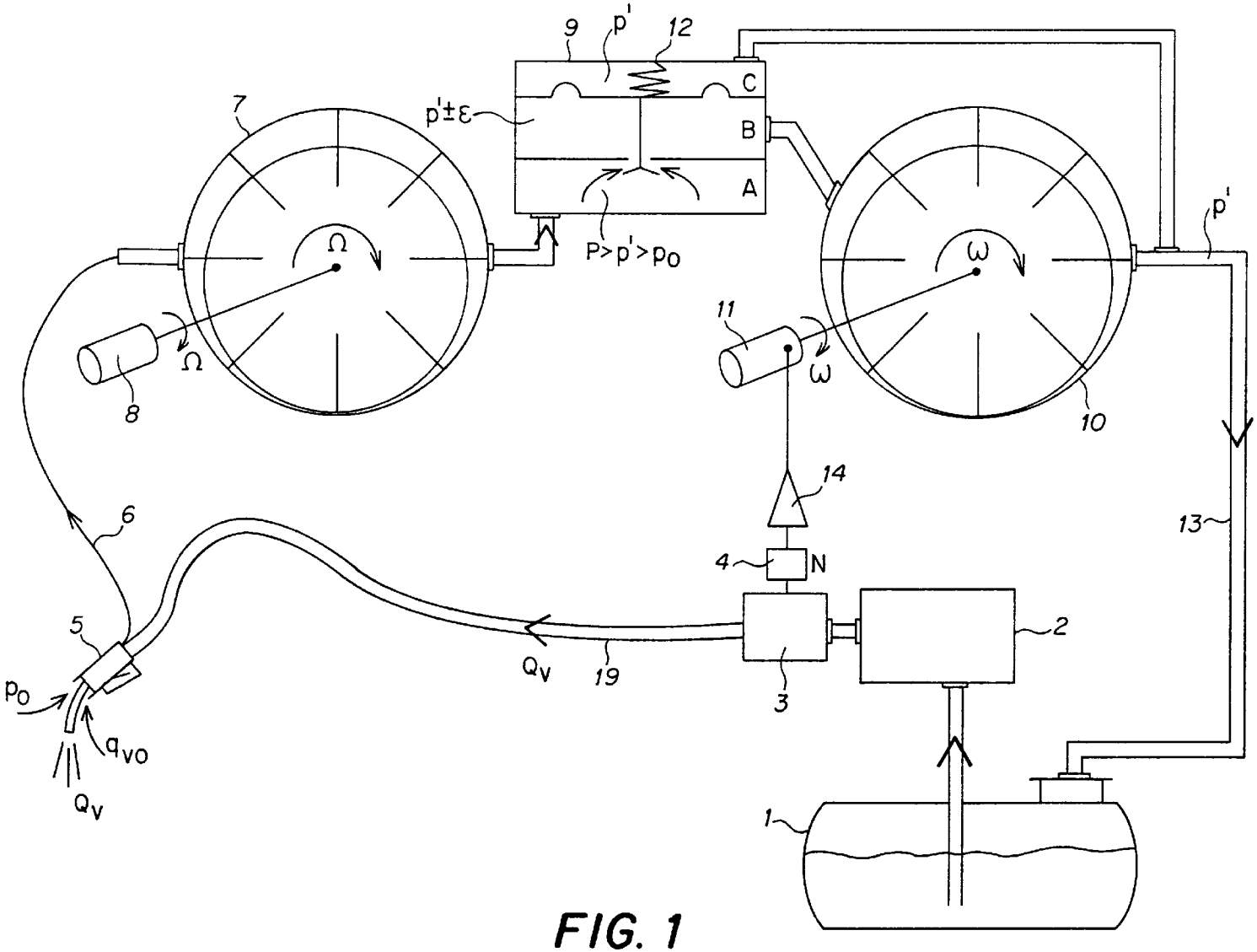
FIG. 1 is a diagram of a first embodiment of the recovery system of the invention.

FIG. 1 shows a system for recovering hydrocarbon vapor given off by motor vehicle tanks while they are being filled with liquid fuel via a dispensing pipe 19. The upstream end of said dispensing pipe 19 is immersed in a storage tank 1 for storing liquid fuel which is sucked up by a pump 2 delivering a volume flow rate $Q_v$. The liquid fuel passes through a measurer 3 placed in the dispenser and suitable for causing a pin to rotate at an angular velocity substantially proportional to $Q_v$. A pulse generator 4, such as an optical disk, coupled to the measurer 3, supplies pulses whose frequency N is proportional to the volume flow rate.

At the outlet from the measurer 3, the dispensing pipe 19 takes the form of a hose pipe terminated by a gun 5 which is of the vapor recovery type in that it is equipped with a sleeve (not shown) serving to prevent the hydrocarbon vapor given off by the vehicle tank as it fills with fuel from dissipating into the atmosphere. Said gun is the starting point of a recovery pipe 6 on which a power pump 7 is placed that may be of arbitrary type, e.g. a vane pump, as shown in FIG. 1.

Said power pump 7 is actuated by a motor 8 having an angular velocity Ω such as to supply at any time almost all of the power necessary for pumping the vapor to be recovered, without necessarily having good metering quality as regards its ratio of flow rate to angular velocity Ω.

If the cycle volume of the pump 7 is V, the angular velocity Ω is maintained at a value such that:

$$\rho V\Omega > \rho_0 q_{v0}$$

where $\rho_0$ and $\rho$ are respectively the density of the hydrocarbon vapor at atmospheric pressure $p_0$, and said density at the inlet of the pump 7, and $q_{v0}$ is the flow rate of the vapor at atmospheric pressure, it being desirable for this flow rate to be made equal to the flow rate $Q_v$ of liquid fuel in the dispensing pipe 19.

Downstream from the power pump 7 a metering pump 10 of the positive displacement type is mounted in series, which pump is driven by a motor 11 controlled by an amplifier 14 suitable for transforming the pulse signals output by the generator 4 into power signals capable of powering the motor 11, e.g. of the stepper type, and of causing it to rotate at an angular velocity ω that is therefore proportional to the volume flow rate $Q_v$ of the liquid fuel delivered by the dispensing pipe 19.

As shown in FIG. 1, the metering pump 10 is mounted in series with and downstream from the power pump 7 via a differential pressure expander-regulator 9 of a conventional model that receives from said power pump 7 hydrocarbon vapor under a pressure P higher than the initial pressure $p_0$. After the vapor has expanded from chamber A to chamber B, the differential pressure Δp between the input and the output of the metering pump 10 is maintained at a value ±ε that is very small. More precisely, the pressure in chamber B of the expander-regulator 9 takes values lying in the range p'−ε to p'+ε, where p' is the pressure at which the metering pump 10 returns vapor to the storage tank 1 inside which the pressure is p', ignoring downstream headloss.

When only the power pump 7 is actuated by the motor 8, extra pressure $P>p_0$ builds up in chamber A of the expander-regulator 9. Since the metering pump 10 is stopped, thereby slowing down the flow of vapor, the pressure rises in chamber B and the valve of the expander-regulator closes immediately, if it was not already fully closed. Starting up the pump 10 enables vapor in B to be removed and the pressure therein falls to a value p'±ε in the vicinity of the reference pressure p' of the regulator, which reference pressure is the pressure continuously existing in the chamber C that is connected to downstream of the metering pump 10, and that is separated from chamber B by the regulating membrane.

An adjustment spring 12 enables the pressures upstream from and downstream from the pump 10 to be adjusted when necessary.

Since the power pump 7 can supply a mass flow rate that is higher than that removed by the metering pump 10, chamber A of the expander-regulator 9 is always under pressure $P>p_0$, and the reduction of P to p'±ε can always take place between chambers A and B via the regulating valve.

Thus, since the metering pump 10 works under very similar upstream and downstream pressures, it acquires very good metering quality, because internal leaks become negligible.

With the mass flow rate of gas to be sucked up being $\rho_0 q_{v0}$, the metering pump 10 must remove and transfer the same quantity p'vω, where v is its cycle volume and ρ' is the density of the vapor under the pressure p' that is common to upstream and to downstream from the pump, hence:

$$\epsilon=\rho_0 q_{v0}/\rho' v=\rho_0 Q_v/\rho' v$$

If, as is generally the case, ρ' is very close to $\rho_0$, to within $10^{-2}$, the motor 11 merely needs to be rotated at the velocity $\omega=Q_v/v$.

Figure 4:
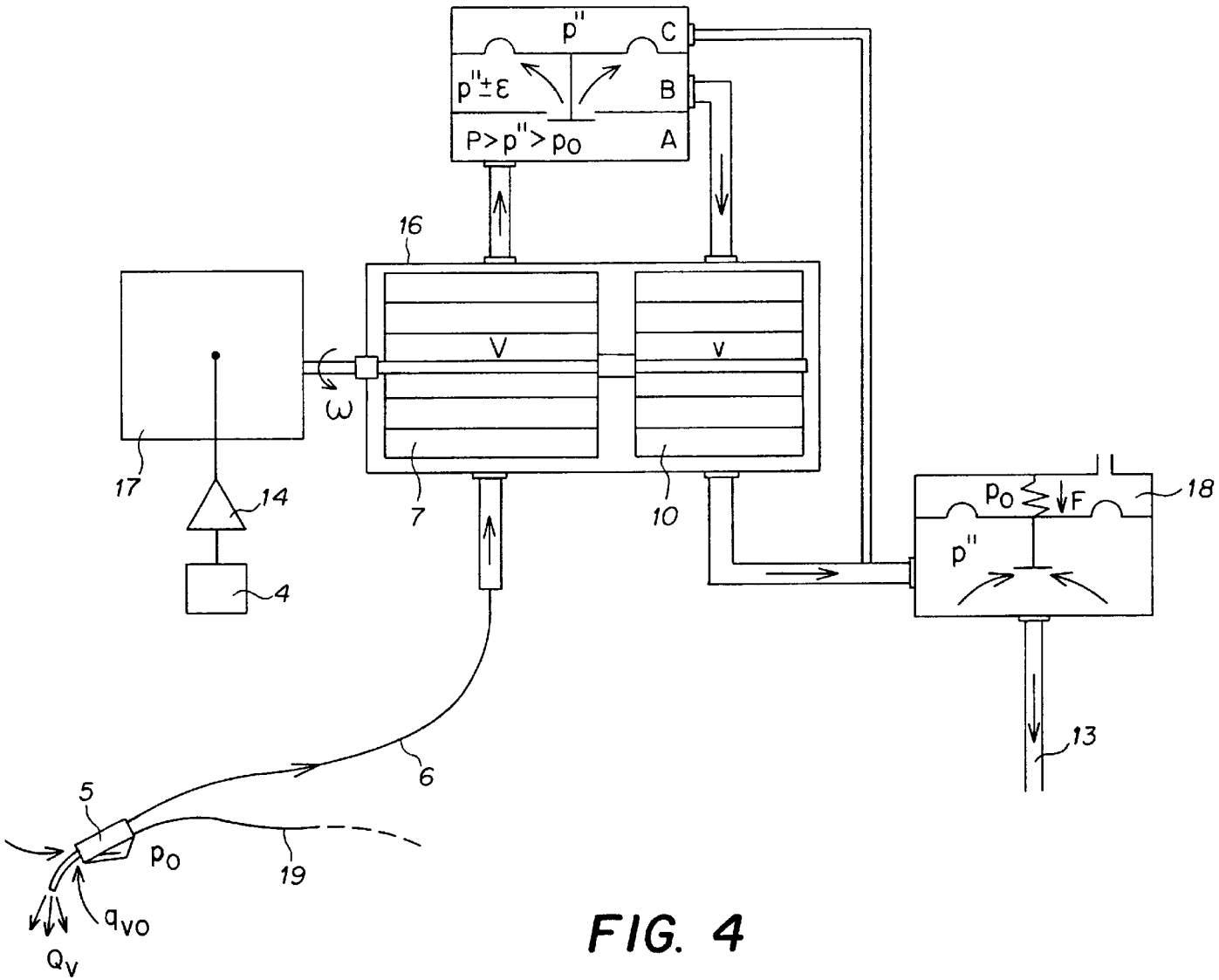
FIG. 4 is a diagram of a variant embodiment of the recovery system shown in FIG. 1.

If the pipe 13 leading to the storage tank 1 is very resistant to flow, or if the tank 1 is maintained under extra pressure, it is merely necessary, as shown in FIG. 4, to dispose a pressure regulator 18 on said pipe 13 downstream from the metering pump 10 and from the expander-regulator 9. The working pressure of the pump 10 is then maintained at a value in the vicinity of p", which value is higher than that necessary for removing vapor to the tank 1. Since in this case the pump 10 operates under the pressure p" to which a vapor density p" corresponds, the angular velocity ω of the pump 10 is adjusted to:

$$\omega=\rho_0 q_{v0}/\rho'' v=p_0 Q_v/\rho'' v\approx p_0 Q_v/p'' v$$

proportional to N if $p_0$, p", and v are fixed.

Figure 2:
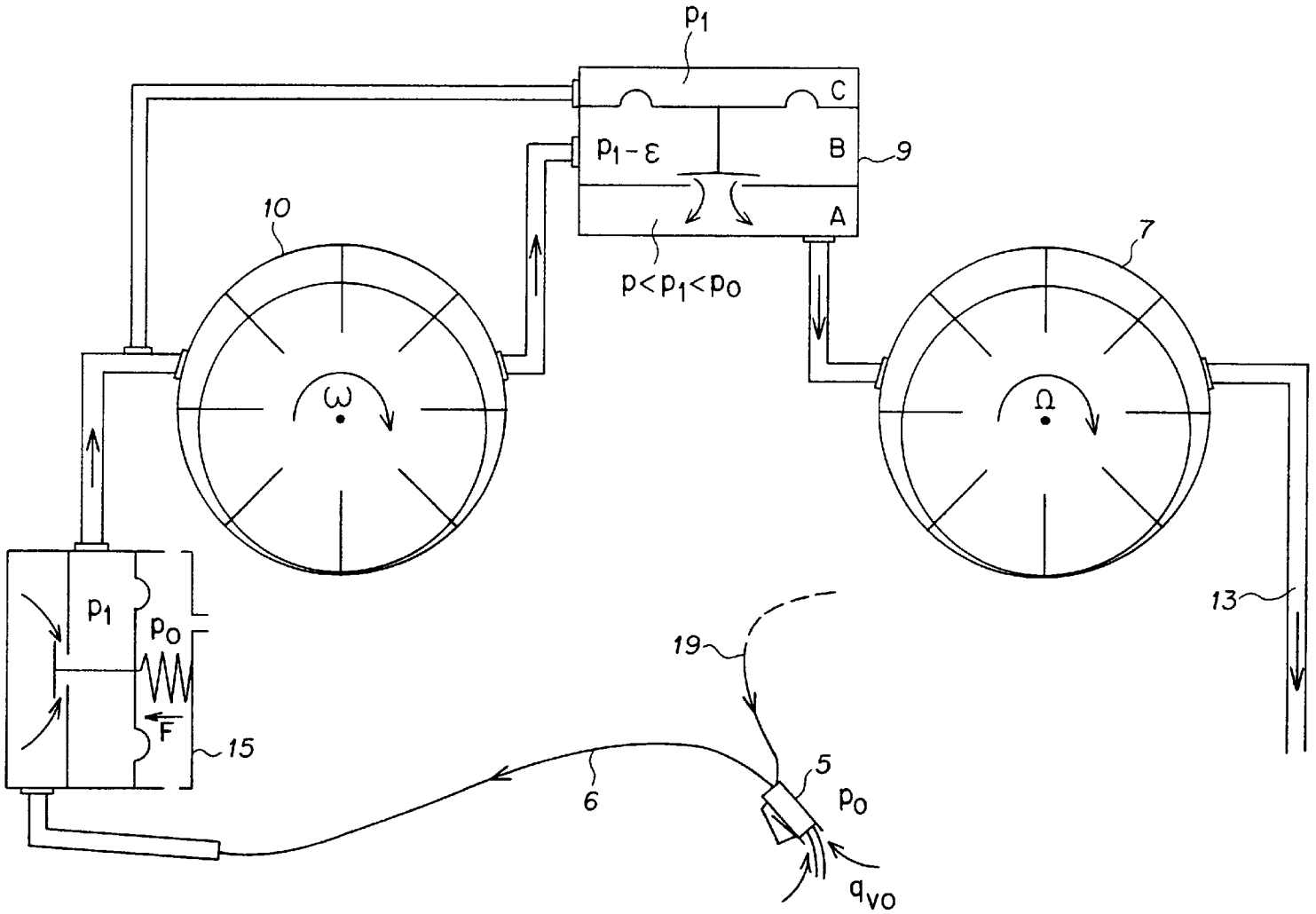
FIG. 2 is a diagram of a second embodiment of the recovery system of the invention.

The embodiment shown in FIG. 2 differs from the embodiment described above with reference to FIG. 1 in that the metering pump 10 operating at $\Delta p \approx 0$ is mounted in series upstream from the power pump 7. It should be noted that, in this case, both the pump 10 and the expander-regulator 9 work under a pressure $P_1$ that is less than $p_0$, and that is created by the suction of the power pump 7, hence the presence upstream from the pump 10 and from the expander-regulator 9 of an expander 15 for reducing the pressure to the value $P_1$.

Furthermore, the power pump 7 situated downstream always supplies enough pressure to deliver vapor when the pipe 13 downstream therefrom opposes resistance to flow.

Once again:

$$\rho_0 q_{v0} = \omega v \rho_1$$

where $\rho_1$ is the density of the vapor at the regulated pressure $p_1$, hence:

$$\omega = \rho_0 q_{v0} / \rho_1 v \approx p_0 Q_v / p_1 v$$

proportional to N if $p_0$ and p1 are fixed.

The vapor recovery system shown in FIG. 2 may be easily extended to a plurality of dispensing pipes.

Figure 3:
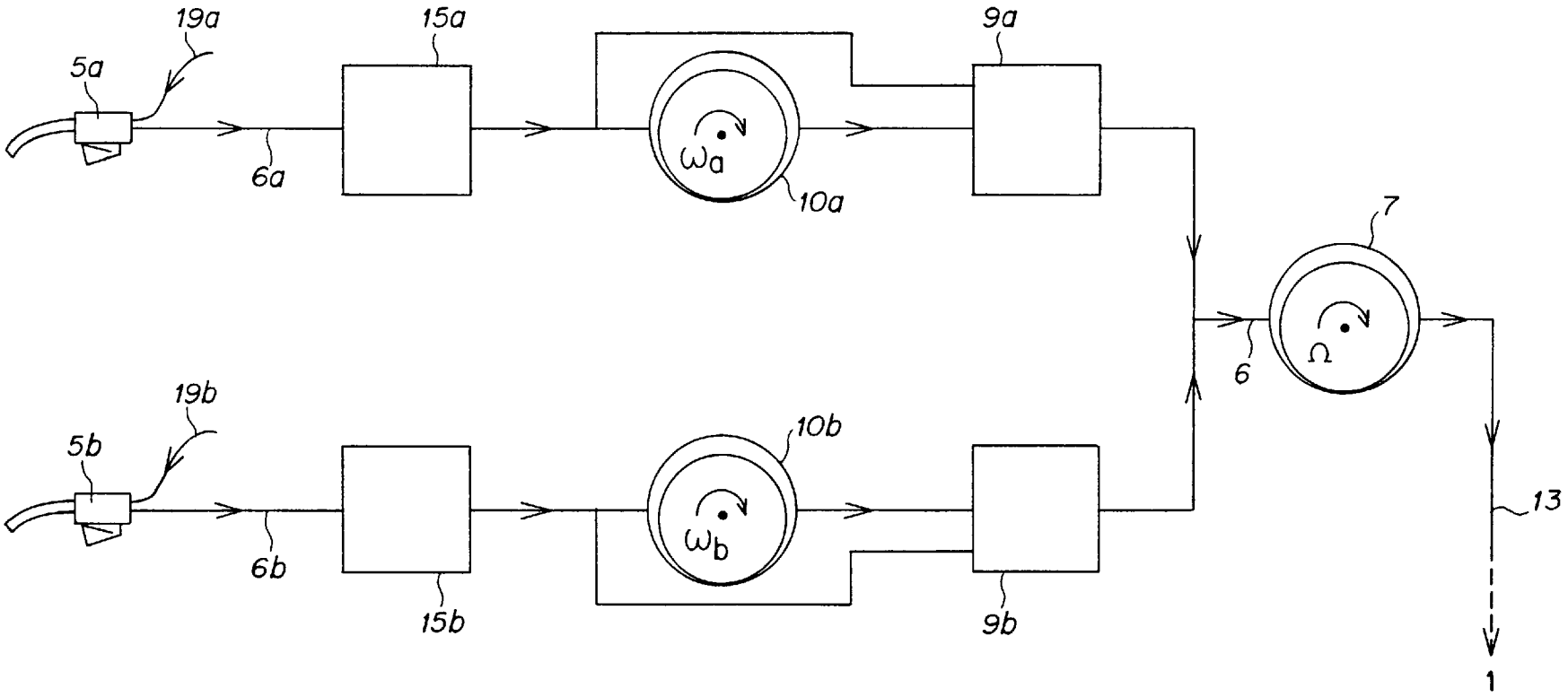
FIG. 3 is a diagram of the recovering system shown in FIG. 2, having multiple dispensing pipes and multiple recovery pipes.

As shown in FIG. 3, in which there are two dispensing pipes 19*a*, 19*b* terminated by respective guns 5*a*, 5*b*, there is a single power pump 7 placed on a common portion 6 that is common to the recovery pipes 6*a*, 6*b* downstream from the differential pressure expander-regulators 9*a*, 9*b*.

The diagram in FIG. 4 shows a variant embodiment of the recovery system of the invention, in which variant embodiment the power pump 7 and the metering pup 10 are driven by a common motor 17 at an angular velocity $\omega$ that is substantially proportional to the volume flow rate $Q_v$ of the delivered liquid fuel.

The outlet of the power pump 7 of cycle volume V is connected to chamber A of the expander-regulator 9. Chambers B and C are connected respectively upstream from and downstream from the pump 10 which thus works at a very small differential pressure, and whose cycle volume v is less than V.

Once again:

$$\omega v \rho'' = \rho_0 q_{v0}$$

i.e.

$$\omega = \rho_0 q_{v0} / p'' v \approx p_0 Q_v / p'' v$$

proportional to N if $p_0$ and p" are fixed.

Since, under these conditions, the metering pump 10 does not remove as much vapor as the pump 7 is capable of supplying, extra pressure $P > p_0$ builds up in chamber A of the expander-regulator 9, and its valve can reduce the pressure of the vapor from P to p" in the vicinity of the inlet of the metering pump 10, which operates under the pressure p" with an inlet/outlet differential pressure in the vicinity of zero.

Another advantageous characteristic of the vapor recovery system of the invention is that it is possible to perform a dry test without making a systematic error due to the differences in viscosity and in molecular mass between air and the mixture of air and of hydrocarbon vapor.

Viscosity and density no longer play any part in establishing the flow rate since said flow rate is determined by the metering pump alone which meters out volumes at constant pressure. Neither do they play any part in internal leaks, since such leaks become negligible.

I claim:

1. A recovery system for recovering hydrocarbon vapor given off by motor vehicle tanks while they are being filled with liquid fuel via at least one dispensing pipe, said recovery system comprising a recovery pipe associated with said dispensing pipe, a power pump placed on said recovery pipe, and a metering pump driven by a motor at an angular velocity that is substantially proportional to the volume flow rate of liquid fuel delivered by the dispensing pipe, said metering pump being mounted in series with said power pump via a differential pressure expander-regulator suitable for maintaining a pressure difference that is small between the outlet and the inlet of the metering pump so as to obtain a vapor volume flow rate that is substantially proportional to the angular velocity imparted by said motor.

2. A recovery system according to claim 1, wherein said power pump and said metering pump are driven by a common motor at an angular velocity that is substantially proportional to said volume flow rate of delivered liquid fuel, the power pump having a cycle volume that is greater than the cycle volume of the metering pump.

3. A recovery system according to claim 1, wherein said metering pump is mounted in series with and downstream from the power pump.

4. A recovery system according to claim 3, wherein a pressure regulator is disposed downstream from the metering pump and from said differential pressure expander-regulator.

5. A recovery system according to claim 1, wherein said metering pump is mounted in series with and upstream from the power pump, an expander being disposed upstream from the metering pump and from said differential pressure expander-regulator.

6. A recovery system according to claim 5, wherein, with there being a plurality of said dispensing pipes, the power pump is common and is placed on a common portion that is common to the respective recovery pipes, downstream from said differential pressure expander-regulators.

* * * * *